US008733975B2

(12) United States Patent
Lee

(10) Patent No.: US 8,733,975 B2
(45) Date of Patent: May 27, 2014

(54) LED LIGHTING APPARATUS

(75) Inventor: Sang-Cheol Lee, Gyeonggi-do (KR)

(73) Assignee: Icepipe Corporation, Seoul (KR)

( * ) Notice: Subject to any disclaimer, the term of this patent is extended or adjusted under 35 U.S.C. 154(b) by 0 days.

(21) Appl. No.: 13/594,183

(22) Filed: Aug. 24, 2012

(65) Prior Publication Data

US 2012/0314415 A1 Dec. 13, 2012

Related U.S. Application Data

(63) Continuation of application No. PCT/KR2010/006768, filed on Oct. 5, 2010.

(30) Foreign Application Priority Data

Feb. 25, 2010 (KR) ..... 10-2010-0017149

(51) Int. Cl.
*F21V 21/00* (2006.01)

(52) U.S. Cl.
USPC ..... 362/249.02; 362/800; 362/294; 362/373

(58) Field of Classification Search
USPC ..... 362/393, 294, 650, 249.02
See application file for complete search history.

(56) References Cited

U.S. PATENT DOCUMENTS

| | | | | |
|---|---|---|---|---|
| 8,262,260 | B2 * | 9/2012 | Mo et al. | 362/294 |
| 8,292,465 | B2 * | 10/2012 | Horng et al. | 362/294 |
| 8,398,266 | B2 * | 3/2013 | Wang | 362/249.02 |
| 8,419,220 | B2 * | 4/2013 | Kong | 362/249.02 |
| 8,430,528 | B2 * | 4/2013 | Yu et al. | 362/249.02 |
| 8,480,255 | B2 * | 7/2013 | Sim | 362/249.02 |
| 8,491,166 | B2 * | 7/2013 | Thompson, III | 362/373 |
| 8,506,118 | B2 * | 8/2013 | Maxik et al. | 362/235 |
| 2008/0043472 | A1 | 2/2008 | Wang | |
| 2008/0117637 | A1 | 5/2008 | Chang et al. | |
| 2008/0186704 | A1 | 8/2008 | Chou et al. | |
| 2009/0040759 | A1 | 2/2009 | Zhang et al. | |
| 2009/0046464 | A1 | 2/2009 | Liu et al. | |
| 2009/0237932 | A1 | 9/2009 | Lee | |

FOREIGN PATENT DOCUMENTS

| | | | |
|---|---|---|---|
| CN | 101334151 | A | 12/2008 |
| CN | 201382395 | Y | 1/2010 |
| JP | 2009163955 | A | 7/2009 |
| KR | 20090000151 | | 1/2009 |

(Continued)

OTHER PUBLICATIONS

Australian Patent Examination Report dated Jan. 17, 2013 received in corresponding Australian Patent Application No. 2010347154, 2 pgs.

(Continued)

*Primary Examiner* — Anabel Ton
(74) *Attorney, Agent, or Firm* — Grossman, Tucker, Perreault & Pfleger, PLLC

(57) ABSTRACT

Disclosed is a light-emitting diode (LED) lighting apparatus. The LED lighting apparatus comprises: a light source module comprising an LED light source; a thermal base coupled to the light source module so as to receive heat generated by the light source module; and a heat-dissipating member comprising a ventilation unit coupled to an edge region of the thermal base so as to discharge heat transmitted from the thermal base and open a central area of the thermal base so as to facilitate air ventilation to the outside. The LED lighting apparatus can increase heat-dissipating efficiency by maximizing ventilation efficiency and enabling air around the heat-dissipating member to flow smoothly without stagnating.

10 Claims, 5 Drawing Sheets

(56) References Cited

FOREIGN PATENT DOCUMENTS

| | | |
|---|---|---|
| KR | 20090076545 | 7/2009 |
| KR | 20090082998 | 8/2009 |
| KR | 20090095903 | 9/2009 |
| WO | 2009048218 A1 | 4/2009 |

OTHER PUBLICATIONS

PCT International Search Report dated May 31, 2011 received in corresponding PCT Application No. PCT/KR2010/006768, 2 pgs.

PCT International Preliminary Report on Patentability/Written Opinion dated Sep. 4, 2012 received in corresponding PCT Application No. PCT/KR2010/006768, 8 pgs.

Japanese Office Action dated Jun. 4, 2013, received in corresponding Japanese Patent Application No. 2012-551899, with English language translation, 5 pgs.

European Search Report dated Nov. 19, 2013, received in related EP Application No. 10846701.0, 10 pgs.

* cited by examiner

LED LIGHTING APPARATUS

CROSS-REFERENCE TO RELATED APPLICATIONS

This application is a continuation of PCT/KR2010/006768 filed Oct. 5, 2010, which claims the benefit of Korean Patent Application No. 10-2010-0017149, filed with the Korean Intellectual Property Office on Feb. 25, 2010, the disclosure of which is incorporated herein by reference in its entirety.

BACKGROUND

1. Technical Field

The present invention relates to an LED lighting apparatus.

2. Background Art

An LED lighting apparatus has a large amount of heat generated due to heat generated by the LED. Generally, when the LED lighting apparatus is overheated, the LED lighting apparatus may malfunction or be damaged, and thus it is essentially required to equip the LED lighting apparatus with a heat-dissipating structure in order to prevent the overheating.

Accordingly, disclosed previously has been an LED lighting apparatus having heat-dissipating fins. In the LED lighting apparatus having heat-dissipating fins therein, the heat-dissipating fins are attached to a cylindrical body that surrounds a light source so as to expand the surface area. However, the heat-dissipating fin structure is limited in expanding the surface area, and the air present in between the heat-dissipating fins is stagnated with heat therein, lowering the heat-dissipating efficiency relative to the surface area.

To improve this problem, Korean Patent Publication 2009-0095903 has disclosed a structure that discharges a linear heat radiation member on an external circumferential surface of the body surrounding a light source. However, in this kind of structure also, the air having the heat held therein is stagnated on the exterior of the body in such a way that the problem of lowered heat-dissipating efficiency remains unsolved. Moreover, the heat generated from the light source is confined in the cylindrical body to cause a thermal bottleneck phenomenon, in which the heat confined in the cylindrical body is not transferred to the heat radiation member quickly enough.

Korean Patent Publication 2009-0076545 has disclosed an LED lighting apparatus in which open heat radiation passages are formed in a heat sink in order to facilitate air flow. However, this kind of structure also merely improves the air flow limitedly at an end portion of the heat sink and thus is not capable of solving the problem caused by the air having the heat held therein, and the problem of insufficient active heat radiation area for heat dissipation still remains unsolved.

SUMMARY

The present invention provides an LED lighting apparatus in which heat-dissipating efficiency is improved by activating air flow around a heat-dissipating member.

An aspect of the present invention features an LED lighting apparatus, which includes: a light source module comprising an LED light source; a thermal base coupled to the light source module so as to receive heat generated by the light source module; and a heat-dissipating member comprising a ventilation unit coupled to an edge region of the thermal base so as to discharge heat transferred from the thermal base and open a central area of the thermal base so as to facilitate air ventilation to the outside.

The LED light source can be provided in plurality, and the plurality of LED light sources can be arranged to correspond to the edge region of the thermal base.

The heat-dissipating member can include a heat-dissipating loop that is constituted with linear members and comprises a spiral structure repeatedly forming a heat-absorbing unit coupled to the edge region of the thermal base to receive heat and a heat-dissipating unit separated from the heat-absorbing unit to dissipate the absorbed heat.

The heat-dissipating loop can include a capillary tube type of heat-pipe loop, into which working fluid is injected.

The thermal base can be formed with a heat-transfer groove in the shape of a trench, and the heat-dissipating loop can be inserted into and arranged in the heat-transfer groove.

The heat-dissipating member can include a hollow-type heat-dissipating fence coupled with the edge region of the thermal base and having a plurality of penetration holes formed therein so as to enable air flow to the inside.

The heat-dissipating fence can be provided in plurality and coupled to the thermal base in a multi-layer structure.

The heat-dissipating member can include a plurality of linear members, each of which has a heat-absorbing unit coupled with the edge region of the thermal base to receive heat and a heat-dissipating unit separated from the heat-absorbing unit to dissipate the absorbed heat.

The thermal base can have a penetration hole formed therein so as to enable air flow.

With the present invention, it becomes possible to improve the heat-dissipating efficiency of the LED lighting apparatus by maximizing ventilation efficiency and enabling air around the heat-dissipating member to flow smoothly without stagnating.

Moreover, the heat-dissipating efficiency can be improved by preventing heat transfer from slowing down because the heat generated by LED is widely diffused.

DETAILED DESCRIPTION

Hereinafter, some embodiments of the present invention will be described with reference to the accompanying drawings.

Figure 1:
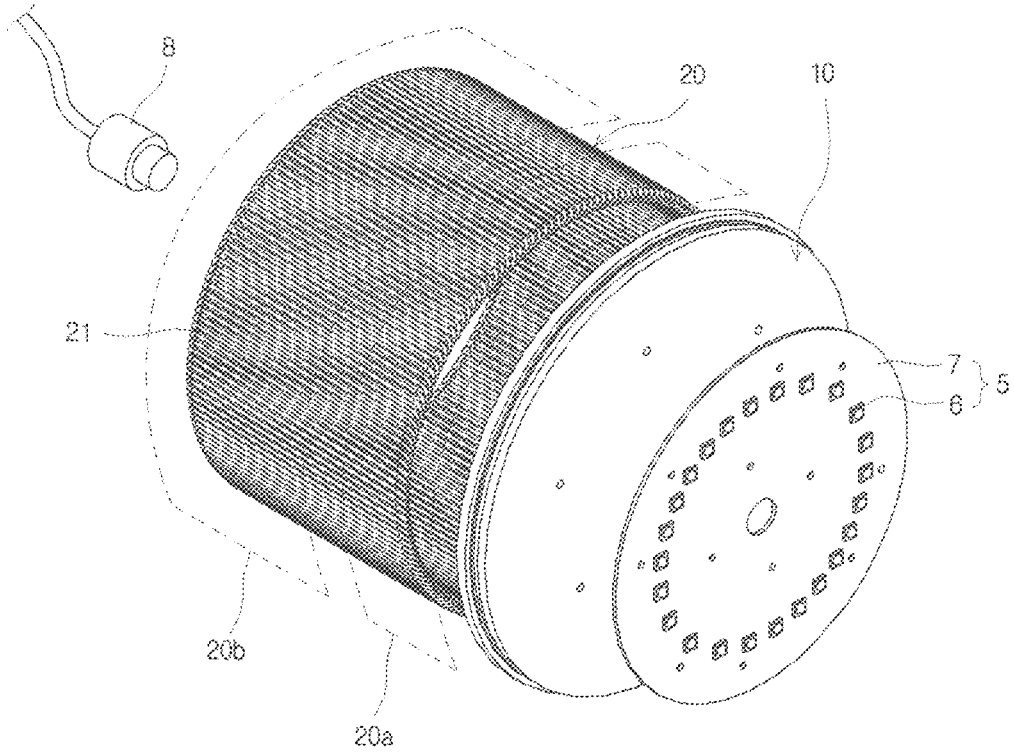
FIG. 1 is an exploded perspective view showing an LED lighting apparatus in accordance with an embodiment of the present invention.
Figure 2:
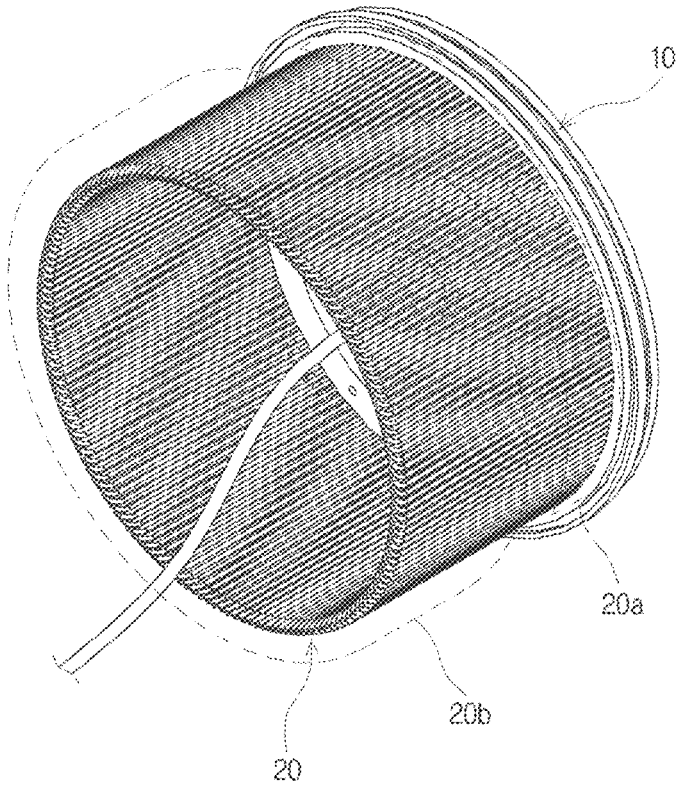
FIG. 2 is a perspective view showing the LED lighting apparatus in accordance with an embodiment of the present invention.

FIG. 1 is an exploded perspective view showing an LED lighting apparatus in accordance with an embodiment of the present invention, and FIG. 2 is a perspective view showing the LED lighting apparatus in accordance with an embodiment of the present invention.

The LED lighting apparatus in accordance with an embodiment of the present invention includes a light source module 5, a thermal base 10 and a heat-dissipating member 20, 30.

The light source module 5 is a portion that includes an LED light source 6, which can emit light by use of electrical energy, to generate light required for lighting. As illustrated in FIG. 1, the light source module 5 in accordance with the present embodiment is constituted with the LED light source 6 and a module board 7, in which the LED light source 7 is mounted.

The thermal base 10 is a portion that receives heat generated by the LED light source 6 and transfers the heat to a heat-dissipating member. For this, one side of the thermal base 10 is coupled with the LED light source 6 so as to enable heat transfer, and an edge region of the thermal base 10 is coupled with the heat-dissipating member so as to enable heat transfer. Accordingly, the heat absorbed by the thermal base 10 can be readily transferred to the heat-dissipating member.

Figure 3:
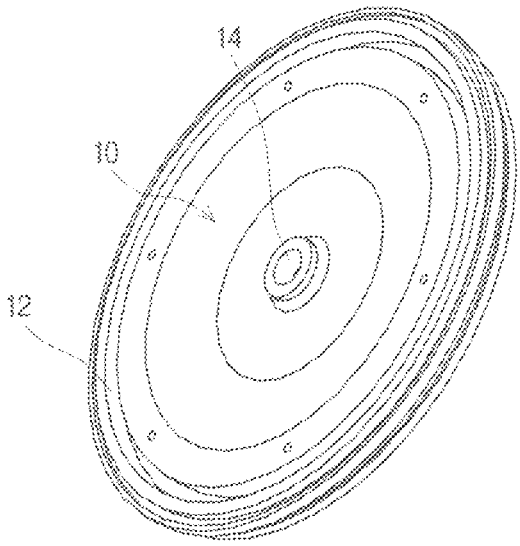
FIG. 3 is a perspective view showing a thermal base of the LED lighting apparatus in accordance with an embodiment of the present invention.
Figure 4:
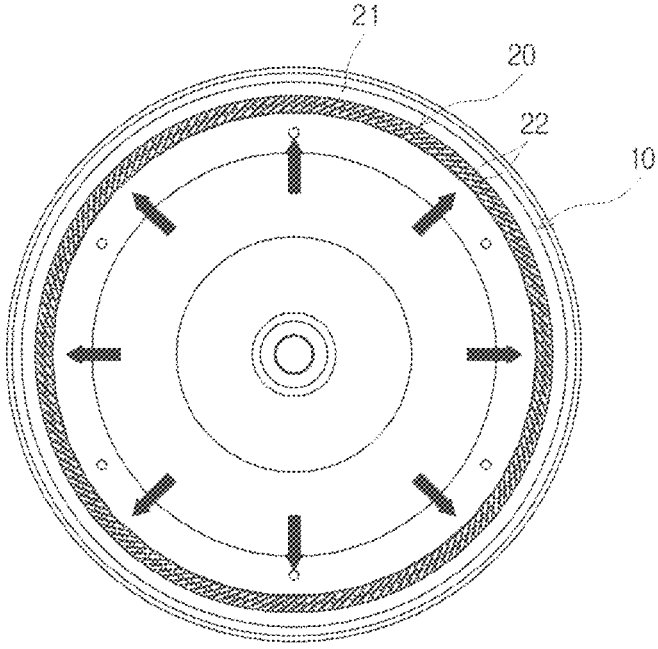
FIG. 4 illustrates heat transfer passages in the thermal base of the LED lighting apparatus in accordance with an embodiment of the present invention.

FIG. 3 is a perspective view showing the thermal base of the LED lighting apparatus in accordance with an embodiment of the present invention, and FIG. 4 illustrates heat transfer passages in the thermal base of the LED lighting apparatus in accordance with an embodiment of the present invention.

As illustrated in FIG. 4, most of the heat absorbed by the thermal base 10 is dissipated through edge regions where the heat-dissipating member is coupled. Accordingly, the heat transfer passages, in which the cross-sectional areas thereof are increased along the passages, are formed in the thermal base 10. As the heat transfer becomes faster with the increase of the cross-sectional areas, the heat absorbed by the thermal base 10 is not stagnated but quickly transferred to the heat-dissipating member to increase the heat-dissipating efficiency.

In the case that the LED light source 6 is provided in plurality, the plurality of LED light sources 6 can be arranged to correspond to the edge region of the thermal base to shorten the heat transfer passages and further improve the speed of heat transfer to the heat-dissipating member.

As illustrated in FIG. 1, in the present embodiment, the light source module 5 having the plurality of circularly-arranged LED light sources 6 is mounted on one surface of the circular thermal base 10, and the cylindrical heat-dissipating member is coupled to the edge region of the other surface of the thermal base 10. As illustrated in FIG. 3, formed in the middle of the thermal base 10 is a penetration hole 14, into which a power cable 8 for supplying electricity to the light source module 5 is inserted.

The heat-dissipating member 20, 30 is a portion that is coupled with the edge region of the thermal base to dissipate the heat transferred from the thermal base 10. Particularly, the heat-dissipating member 20, 30 of the present embodiment is formed with a ventilation unit 22, 32 that opens a central area of the thermal base 10 and allows the air to flow freely so as to facilitate air ventilation to the outside.

Figure 5:
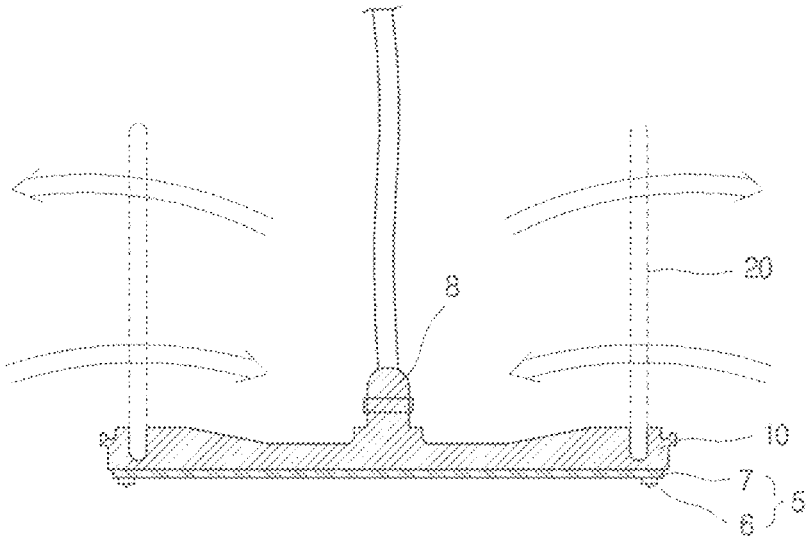
FIG. 5 illustrates air flow in the LED lighting apparatus in accordance with an embodiment of the present invention.

FIG. 5 illustrates air flow in the LED lighting apparatus in accordance with an embodiment of the present invention.

As illustrated in FIG. 5, the LED lighting apparatus of the present embodiment has an inside that is sufficiently hollow to open the central area of the thermal base 10, and the hollow space inside the thermal base 10 allows for easy ventilation with the outside through the ventilation unit. Accordingly, ventilation efficiency of the LED lighting apparatus is maximized so that the air around the heat-dissipating member is not stagnated but flows freely to improve the heat-dissipating efficiency. That is, by increasing the ventilation efficiency and facilitating continuous air flow around the heat-dissipating member, it becomes possible to prevent the air having the heat held therein from stagnating and lowering the heat-dissipating performance.

Moreover, the air ventilated toward the inside works to dissipate not only the heat of the heat-dissipating member but also the heat absorbed by the thermal base 10, further enhancing the heat-dissipating efficiency. In other words, the surface of the thermal base 10 can be also utilized as an active area for heat dissipation. It is also possible that the thermal base 10 is formed with a penetration hole for ventilation, to further enhance the ventilation efficiency of the LED lighting apparatus.

Specifically, as illustrated in FIGS. 1 and 2, the heat-dissipating member in accordance with the present embodiment can include a spiral structure of heat-dissipating loop 20 that is constituted with linear members repeatedly forming a heat-absorbing unit 20*a*, which is coupled to the edge region of the thermal base 10 to receive heat, and a heat-dissipating unit 20*b*, which is separated from the heat-absorbing unit 20*a* to discharge the absorbed heat. In other words, the heat-dissipating loop 20 has a spiral structure that reciprocates between a region that is coupled with the thermal base 10 and a region that is apart from the thermal base 10. Accordingly, a gap between spirals of the heat-dissipating loop 20 becomes the ventilation unit 22, through which air is freely ventilated to the outside. In addition, by forming the heat-dissipating member in a spiral structure, the surface area required for heat dissipation can be maximized in a limited space.

Moreover, as illustrated in FIG. 3, the thermal base 10 is formed with a heat-transfer groove 12 in the shape of a trench, and as illustrated in FIG. 2, the heat-dissipating loop 20 can be successively inserted into and coupled with the heat-transfer groove 12. Accordingly, by filling solder and the like in the heat-transfer groove 12 after inserting the heat-dissipating loop 20, the heat-dissipating loop 20 can be readily coupled with the thermal base 10. Moreover, elastic force is at work between spiral-shaped loops of the heat-dissipating loop 20 so that each loop of the heat-dissipating loop 20 inserted into the heat-transfer groove 12 can be separated from adjacent loops and maintain its inserted form by the elastic force.

Here, as illustrated in FIG. 4, each loop of the heat-dissipating loop 20 inserted in the heat-transfer groove 12 is arranged at an angle in the heat-transfer groove 12 so as to increase the density of the arranged heat-dissipating loop 200 and the area of contact with the thermal base 10.

Moreover, the heat-dissipating loop 20 can include a capillary tube type of heat-pipe loop 25, into which working fluid 26 is injected.

Figure 6:
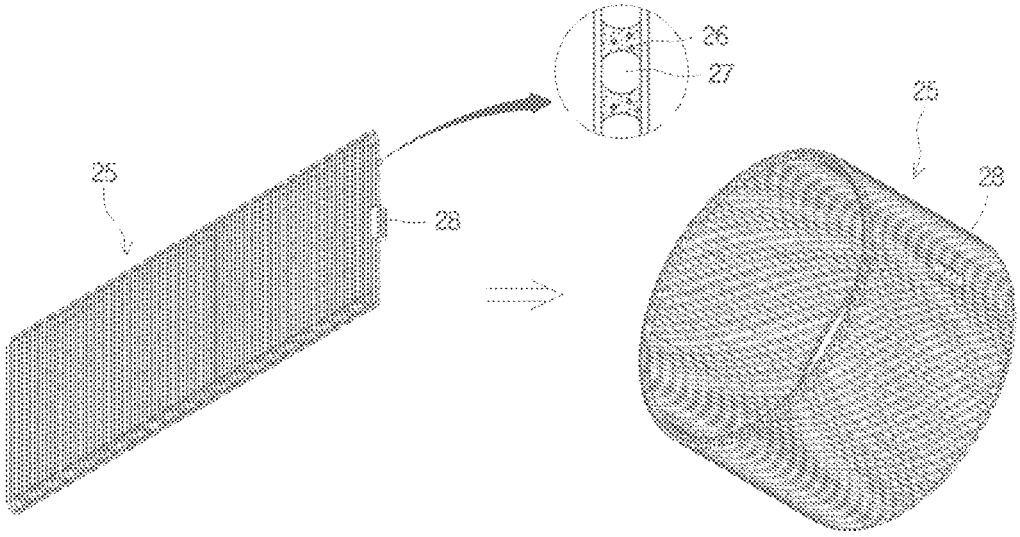
FIG. 6 is a perspective view showing a heat pipe loop of the LED lighting apparatus in accordance with an embodiment of the present invention.

FIG. 6 is a perspective view showing the heat pipe loop of the LED lighting apparatus in accordance with an embodiment of the present invention.

As illustrated in FIG. 5, the heat-pipe loop 25 in accordance with the present embodiment has an oscillating capillary tube type of a heat pipe formed in a spiral structure therein, and the oscillating capillary tube type heat pipe has a structure in which the working fluid 26 and air bubbles 27 are injected in a predetermined ratio into the capillary tube and then the capillary tube is sealed from the outside. Accordingly, the oscillating capillary tube type heat pipe has a heat transfer cycle in which heat is mass transported in the form of latent heat by volume expansion and condensation of the air bubbles 27 and the working fluid 26. As a result, the heat-dissipating efficiency of the heat-dissipating member can be maximized.

Here, the heat-pipe loop 25 can be generally formed in the shape of a board. The board-shaped heat-pipe loop 25 can be formed in a cylindrical shape by rolling the heat-pipe loop 25 in an annular shape and having both ends of the heat-pipe loop 25 by a joint 28. The cylindrical-shape heat-pipe loop 25 can be readily inserted in the heat-transfer groove 12 and can have a higher heat-dissipating efficiency because air flow required for heat dissipation becomes freer.

The heat-dissipating member constituted with the linear members is not restricted to the spiral loop type but can be embodied in various permutations, for example, a parallel-arranged plurality of linear members, each of which has a heat-absorbing unit coupled with the edge region of the thermal base 10 to receive heat and a heat-dissipating unit separated from the heat-absorbing unit to dissipate the absorbed heat.

Moreover, the heat-dissipating member can be embodied in various other forms than the linear members.

Figure 7:
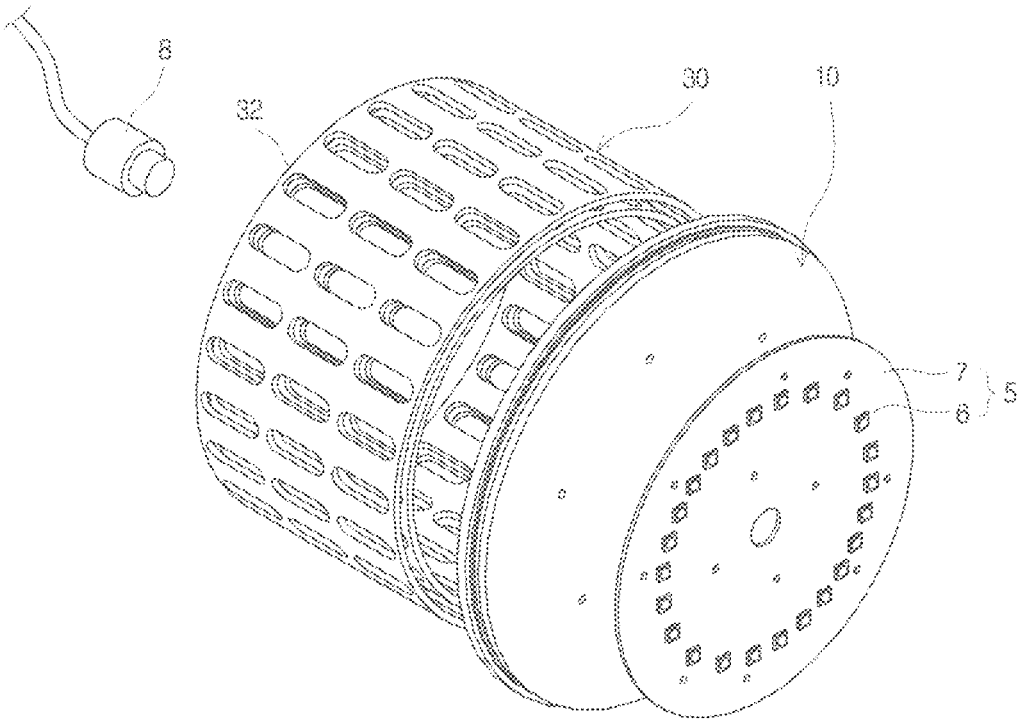
FIG. 7 is an exploded perspective view showing an LED lighting apparatus in accordance with another embodiment of the present invention.
Figure 8:
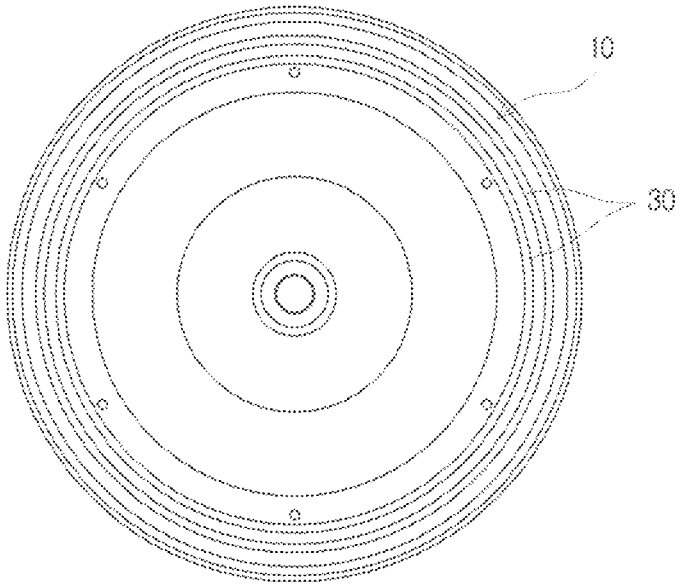
FIG. 8 illustrates a heat-dissipating fence structure of the LED lighting apparatus in accordance with another embodiment of the present invention.

FIG. 7 is an exploded perspective view showing an LED lighting apparatus in accordance with another embodiment of the present invention, and FIG. 8 illustrates a heat-dissipating fence structure of the LED lighting apparatus in accordance with another embodiment of the present invention.

As illustrated in FIG. 7, the heat-dissipating member in accordance with the present embodiment includes a hollow-type heat-dissipating fence 30, which is coupled with the edge region of the thermal base 10 and has a plurality of penetration holes formed therein so as to enable air flow to the inside. Accordingly, the plurality of penetration holes formed in the heat-dissipating fence 30 become the ventilation unit 32, and the inside of the LED lighting apparatus in accordance with the present embodiment can have free air ventilation with the outside through the penetration holes.

The heat-dissipating fence 30 in accordance with the present embodiment is very easy to manufacture and be coupled with the thermal base 10. Moreover, as illustrated in FIG. 8, the heat-dissipating efficiency can be further improved by coupling a plurality of multi-layer heat-dissipating fences 30 to the thermal base.

While the present invention has been described with reference to certain embodiments, the embodiments are for illustrative purposes only and shall not limit the invention. It is to be appreciated that those skilled in the art can change or modify the embodiments without departing from the scope and spirit of the invention.

It shall be also appreciated that a very large number of embodiments other than those described herein are possible within the scope of the present invention, which shall be defined by the claims appended below.

What is claimed is:

1. An LED lighting apparatus comprising:

a light source module comprising a plurality of LED light sources;

a thermal base coupled to the light source module so as to receive heat generated by the light source module; and a heat-dissipating member comprising a ventilation unit coupled to an edge region of the thermal base so as to discharge heat transferred from the thermal base and open a central area of the thermal base so as to facilitate air ventilation to the outside, and wherein the plurality of LED light sources are arranged to correspond to the edge region of the thermal base.

2. An LED lighting apparatus comprising:

a light source module comprising an LED light source;

a thermal base coupled to the light source module so as to receive heat generated by the light source module; and a heat-dissipating member comprising a ventilation unit coupled to an edge region of the thermal base so as to discharge heat transferred from the thermal base and open a central area of the thermal base so as to facilitate air ventilation to the outside, wherein the heat-dissipating member comprises a heat-dissipating loop that is constituted with linear members and comprises a spiral structure repeatedly forming a heat-absorbing unit coupled to the edge region of the thermal base to receive heat and a heat-dissipating unit separated from the heat-absorbing unit to dissipate the absorbed heat, and wherein the heat-dissipating loop comprises a capillary tube type of heat-pipe loop, into which working fluid is injected.

3. An LED lighting apparatus comprising:

a light source module comprising an LED light source;

a thermal base coupled to the light source module so as to receive heat generated by the light source module; and a heat-dissipating member comprising a ventilation unit coupled to an edge region of the thermal base so as to discharge heat transferred from the thermal base and open a central area of the thermal base so as to facilitate air ventilation to the outside, wherein the heat-dissipating member comprises a heat-dissipating loop that is constituted with linear members and comprises a spiral structure repeatedly forming a heat-absorbing unit coupled to the edge region of the thermal base to receive heat and a heat-dissipating unit separated from the heat-absorbing unit to dissipate the absorbed heat, and wherein the thermal base is formed with a heat-transfer groove in the shape of a trench, and wherein the heat-dissipating loop is inserted into and arranged in the heat-transfer groove.

4. An LED lighting apparatus comprising:

a light source module comprising an LED light source;

a thermal base coupled to the light source module so as to receive heat generated by the light source module; and a heat-dissipating member comprising a ventilation unit coupled to an edge region of the thermal base so as to discharge heat transferred from the thermal base and open a central area of the thermal base so as to facilitate air ventilation to the outside, and wherein the heat-dissipating member comprises a hollow-type heat-dissipating fence coupled with the edge region of the thermal base and having a plurality of penetration holes formed therein so as to enable air flow to the inside.

5. The LED lighting apparatus of claim 4, wherein the heat-dissipating fence is provided in plurality and coupled to the thermal base in a multi-layer structure.

6. The LED lighting apparatus of claim 2, wherein the thermal base has a penetration hole formed therein so as to enable air flow.

7. The LED lighting apparatus of claim 1, wherein the heat-dissipating member comprises a heat-dissipating loop that is constituted with linear members and comprises a spiral structure repeatedly forming a heat-absorbing unit coupled to the edge region of the thermal base to receive heat and a heat-dissipating unit separated from the heat-absorbing unit to dissipate the absorbed heat.

8. The LED lighting apparatus of claim 1, wherein the heat-dissipating member comprises a hollow-type heat-dissipating fence coupled with the edge region of the thermal base and having a plurality of penetration holes formed therein so as to enable air flow to the inside.

9. The LED lighting apparatus of claim 1, wherein the heat-dissipating member comprises a plurality of linear members, each of which has a heat-absorbing unit coupled with the edge region of the thermal base to receive heat and a heat-dissipating unit separated from the heat-absorbing unit to dissipate the absorbed heat.

10. The LED lighting apparatus of claim 1, wherein the thermal base has a penetration hole formed therein so as to enable air flow.

* * * * *